US008430712B2

(12) United States Patent
O'Connor et al.

(10) Patent No.: US 8,430,712 B2
(45) Date of Patent: Apr. 30, 2013

(54) TRACK SET

(75) Inventors: Stacy O'Connor, Long Beach, CA (US); Michael Nuttall, South Pasadena, CA (US)

(73) Assignee: Mattel, Inc., El Segundo, CA (US)

( * ) Notice: Subject to any disclaimer, the term of this patent is extended or adjusted under 35 U.S.C. 154(b) by 1139 days.

(21) Appl. No.: 11/744,738

(22) Filed: May 4, 2007

(65) Prior Publication Data

US 2007/0293122 A1 Dec. 20, 2007

Related U.S. Application Data

(60) Provisional application No. 60/798,036, filed on May 4, 2006, provisional application No. 60/812,210, filed on Jun. 9, 2006.

(51) Int. Cl.
*A63H 18/00* (2006.01)

(52) U.S. Cl.
USPC ..... 446/444; 446/487; 446/429

(58) Field of Classification Search ..... 446/444, 446/429, 168–174, 75, 487
See application file for complete search history.

(56) References Cited

U.S. PATENT DOCUMENTS

| | | | | | |
|---|---|---|---|---|---|
| 2,729,914 | A | * | 1/1956 | Cook | 446/168 |
| 2,992,598 | A | * | 7/1961 | Einfalt | 446/444 |
| 3,108,398 | A | * | 10/1963 | Einfalt | 446/444 |
| 3,379,440 | A | * | 4/1968 | Jaffe | 446/168 |
| 3,542,366 | A | | 11/1970 | Schocker | |
| 3,769,743 | A | | 11/1973 | Benkoe et al. | |
| 4,217,727 | A | * | 8/1980 | Fetty et al. | 104/302 |
| 4,227,693 | A | | 10/1980 | Moe et al. | |
| 4,249,733 | A | | 2/1981 | Eddins et al. | |
| 4,251,949 | A | | 2/1981 | Buck et al. | |
| 4,267,661 | A | | 5/1981 | Hanson | |
| 4,285,157 | A | | 8/1981 | Lambert | |
| 4,349,983 | A | * | 9/1982 | Kilroy et al. | 446/75 |
| 4,433,504 | A | * | 2/1984 | Terui | 446/75 |
| 4,513,967 | A | | 4/1985 | Halford et al. | |
| 4,558,867 | A | * | 12/1985 | Hippely | 446/444 |
| 4,585,166 | A | * | 4/1986 | Stephens | 446/168 |
| 4,605,230 | A | | 8/1986 | Halford et al. | |
| D292,602 | S | | 11/1987 | Jones et al. | |
| 4,715,843 | A | | 12/1987 | Ostendorff et al. | |
| 4,898,404 | A | * | 2/1990 | Babcock | 446/444 |
| 4,937,207 | A | * | 6/1990 | Simmell et al. | 446/75 |

(Continued)

FOREIGN PATENT DOCUMENTS

| | | |
|---|---|---|
| DE | 3121568 | 12/1982 |
| WO | WO9201497 | 2/1992 |
| WO | WO9303808 | 3/1993 |
| WO | WO0211849 | 2/2002 |

OTHER PUBLICATIONS

1990 Mattel Catalog, p. 38, "Hot Wheels Custom Car Center Sto & Go 7554" (1 page).

*Primary Examiner* — Gene Kim
*Assistant Examiner* — Urszula M Cegielnik
(74) *Attorney, Agent, or Firm* — Edell, Shapiro & Finnan LLC

(57) ABSTRACT

A track set is provided. The track say may include at least two selectively positionable track arms each with a toy vehicle launcher, each track arm further defining a vehicle pathway, where each track arm may be positioned in at least an extended play configuration and a folded storage configuration.

17 Claims, 4 Drawing Sheets

U.S. PATENT DOCUMENTS 4,961,716 A * 10/1990 Hippely et al. ..... 446/75
5,102,133 A * 4/1992 Chilton et al. ..... 446/444
5,254,030 A 10/1993 Ostendorff et al.
5,643,036 A 7/1997 Liu et al.
D393,495 S 4/1998 Blumenthal
5,791,253 A * 8/1998 Schultheis et al. ..... 446/444
5,813,351 A * 9/1998 Chen ..... 238/10 A
5,931,099 A * 8/1999 Bruner et al. ..... 446/75
5,961,149 A 10/1999 Hunt
6,000,992 A 12/1999 Lambert
6,062,942 A 5/2000 Ogihara
6,099,380 A 8/2000 Rasmussen
6,435,929 B1 8/2002 Halford
6,572,436 B1 6/2003 So
6,619,962 B1 * 9/2003 Gubitosi et al. ..... 446/168
6,783,419 B1 * 8/2004 Paukert et al. ..... 446/75
6,913,508 B2 7/2005 Hornsby et al.
6,951,497 B1 10/2005 Ngan
7,946,903 B2 * 5/2011 Sheltman ..... 446/444
2003/0216102 A1 11/2003 Reisher et al.
2006/0021905 A1 2/2006 Johnson
2006/0099875 A1 5/2006 Cartlidge et al.
2008/0009224 A1 * 1/2008 Nuttall et al. ..... 446/444

* cited by examiner

TRACK SET

CROSS REFERENCE TO RELATED APPLICATIONS

The present application claims priority to provisional application Ser. No. 60/798,036, filed on May 4, 2006, entitled, "Toy Vehicle Play Structures" and also claims priority to provisional application Ser. No. 60/812,210, filed Jun. 9, 2006, entitled, "Toy Vehicle Play Structures", the entire contents of each of which are incorporated herein by reference in their entirety for all purposes.

BACKGROUND

Toy vehicle track sets have been popular for many years and generally include one or more track sections arranged to form a path around which one or more toy vehicles can travel. In order to increase play value of the track sets, various track amusement features have been added to the track sets. For example, track features, such as stunt devices or elements, including loops, jumps, collision intersections, etc., have been included in such track sets to increase the play value of the track sets.

Likewise, toy vehicle track sets have been designed to enable little or no assembly, as well as, easy conversion between storage and play configurations. For example, foldable track sets have been provided in which the track set folds into a compact storage position.

However, many such foldable track sets have provided limited vehicle pathways such that competitive vehicle interaction or vehicle collisions have been limited. The limited nature of vehicle play may result in loss of interest in the track set over a short period of time. Additional interactive features, such as features which allow play with more than one vehicle simultaneously on different vehicle paths and/or to create competitive vehicle play may increase the play value of the track set.

WRITTEN DESCRIPTION

A track set having at least two adjustable track arms selectively positionable to define corresponding vehicle pathways is provided. Further, the track arms may be foldable so as to enable easily the track set to be reconfigured into a folded configuration for storage, display, and/or transport.

Figure 1:
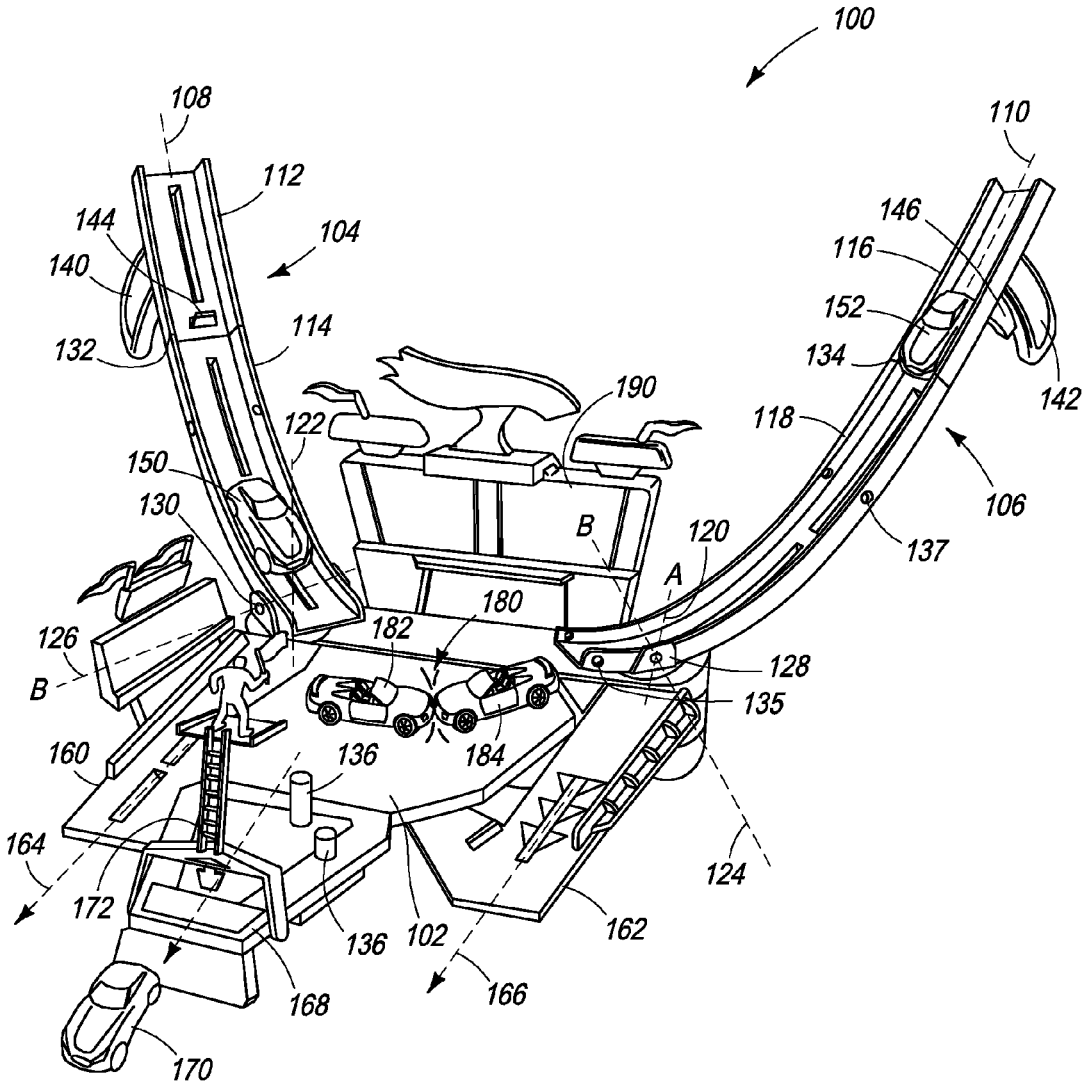
FIG. 1 shows an example toy vehicle track set including a platform and adjustable arms.

Referring now to FIG. 1, an example track set 100 is illustrated. Track set 100 includes a platform 102 and track arms 104, 106. Although illustrated with two track arms, it should be appreciated that the track set may include any number of track arms, for example, the track set may have one, two, three, or four or more track arms.

Track arms 104, 106 may be selectively positioned such that a user may provide different configurations for the track set. As an example, track arms 104, 106 define vehicle paths 108, 110 respectfully. In the illustrated embodiments, the track arms are positioned such that the vehicle paths intersect at platform 102, which may include a collision zone. In one embodiment, vehicles launched from track arms 104, 106 are configured to collide or crash on platform 102. Alternatively, the track arms may be positioned to enable side-by-side racing and/or aiming at targets and/or obstacles. Further, although track arms 104, 106 are shown as defining curved line vehicle paths 108, 110, track arms may be of any suitable configuration and may optionally include additional track features, including straight sections, stunts, jumps, loops, etc. Further, although track arms 104, 106 are shown as being similarly sized in regards to the length of the track and the vehicle path, it should be appreciated that the track arms may be of different sizes, such that one track arm may be longer or shorter and define a longer or shorter path compared to another track arm.

As noted herein, track arms 104, 106 may be selectively positionable. FIG. 1 shows each of track arms 104, 106 selectively rotatable about two axes A and B. Specifically, track arm 104 may be rotated about axes 120 and 122 via pivot connector 130 and track arm 106 may be rotated about axes 124 and 126 via pivot connector 128. Such pivoting may enable the track arms 104, 106 to provide more or less vertical travel (and thus speed generated by gravity) and vary a jumping angle when launched. Further, the pivoting may enable the direction of travel across and onto platform 102 to be selectively varied. For example, FIG. 1 shows example vehicle pathways 164, 166 along ramps 160, 162, respectively, where track arms 104, 106 may be aligned with the ramps to enable side-by-side racing, without a collision, for example. In another example, the track arms 104, 106 may be aimed at a finish line, such as 168, to race and/or test aiming accuracy and speed, where FIG. 1 shows how vehicle 170 may travel through finish line 168 along pathway 172 while avoiding obstacles 136. While in this example two axes of rotation, A and B, are provided, the track arms may rotate and/or pivot about a more or less axes. Also, while finish line 168 is one example target that may be included, various other targets may also be used as described herein.

Track arms 104, 106 may be releaseably coupled to pivot connectors 130, 128, such that the tracks may be re-positioned to pivot about different positions along the length of the track arms. For example, a plurality of holes 137 may be used to enable adjustment of the pivot position along the track arm length, if desired.

Figure 2:
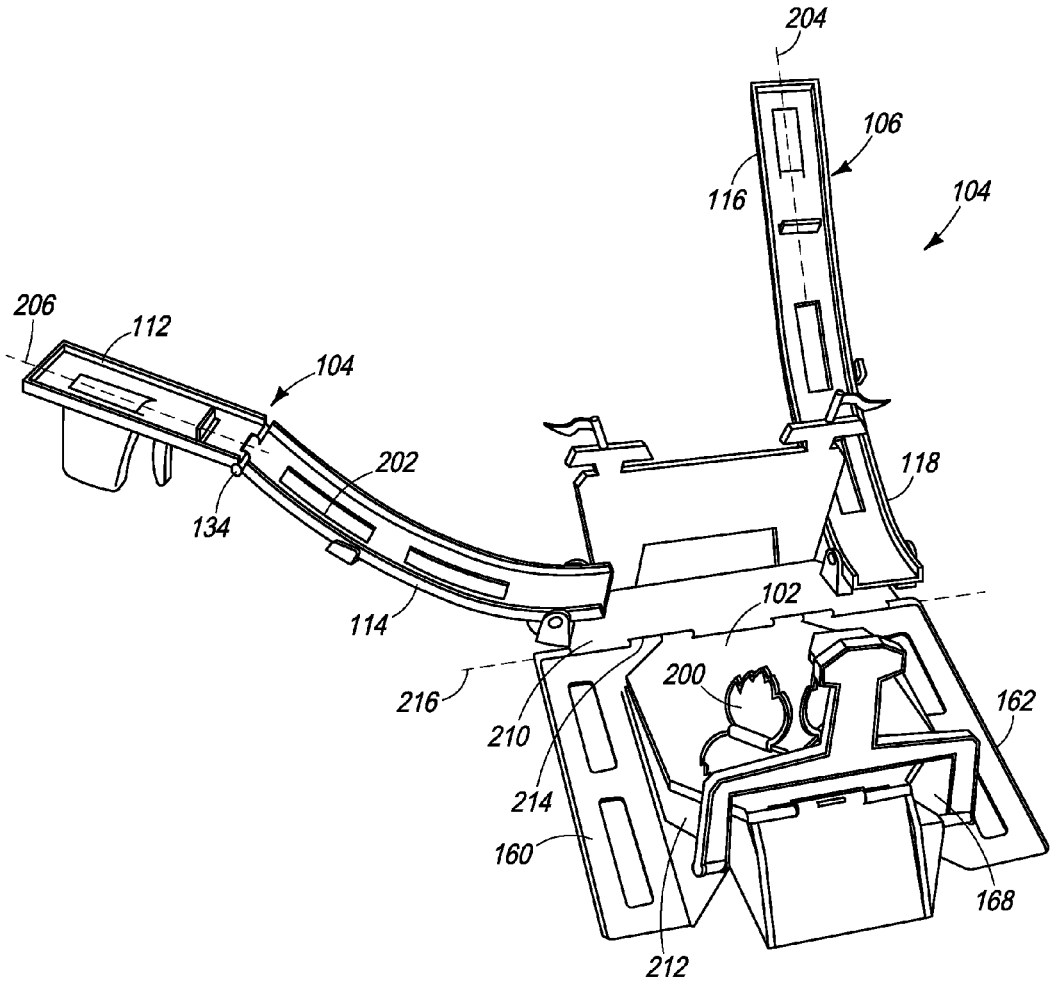
FIG. 2 further illustrates the toy vehicle track set of FIG. 1 in an alternate configuration.
Figure 3:
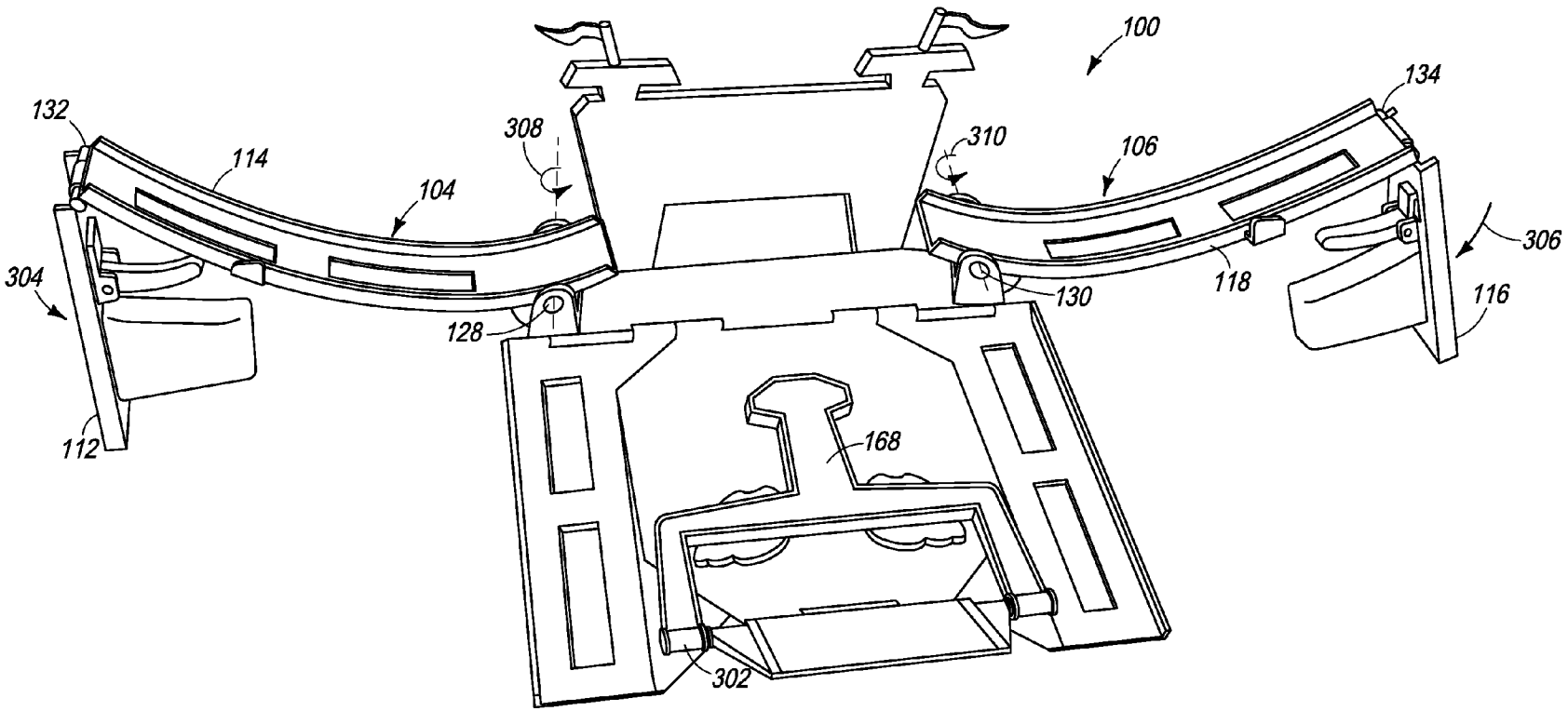
FIG. 3 further illustrates the toy vehicle track set of FIG. 1 in a partially folded position.
Figure 4:
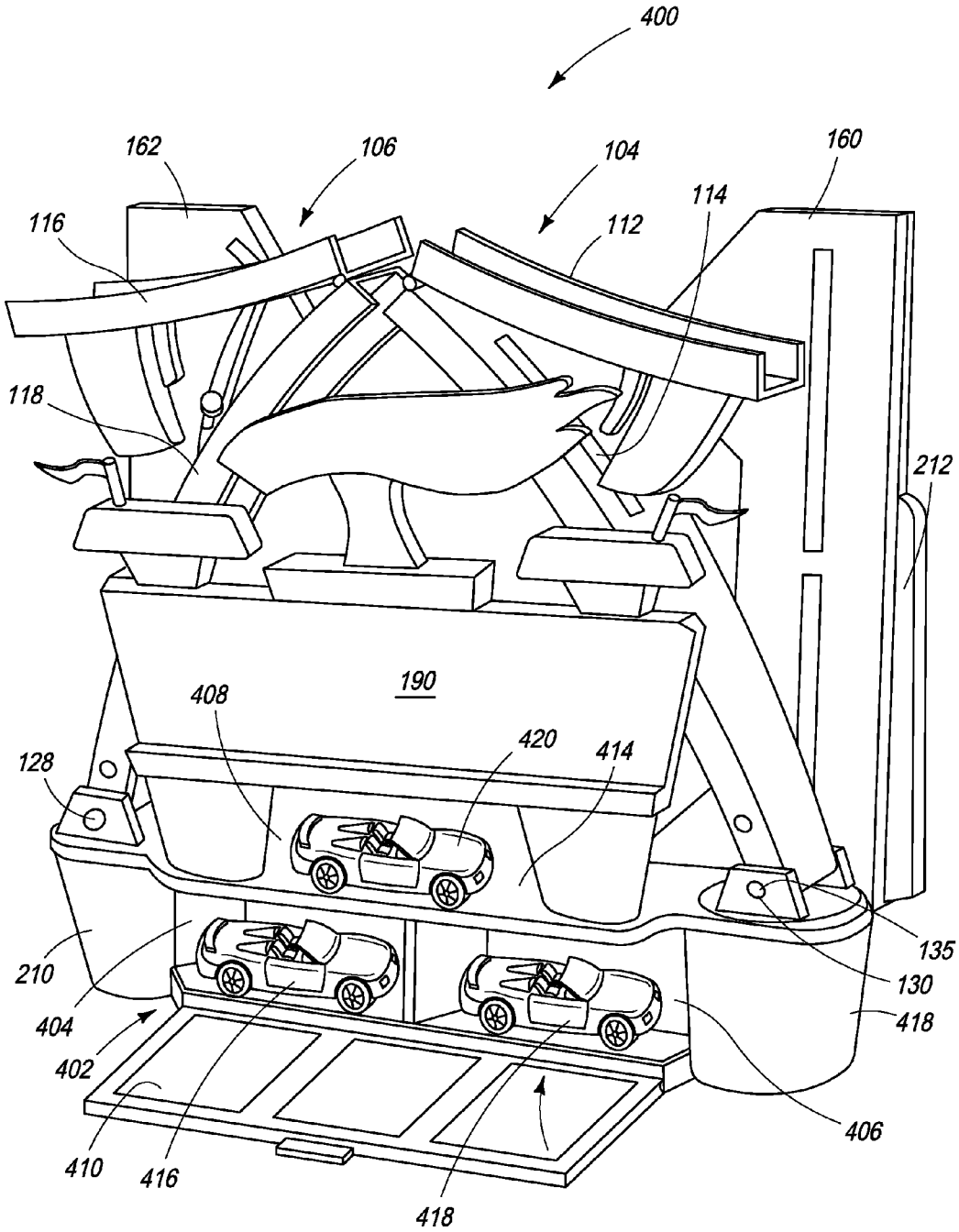
FIG. 4 further illustrates the toy vehicle track set of FIG. 1 in a folded position.

Track arms 104, 106 may also include one or more hinges about which the track arms may fold. FIG. 1 shows track arm 104 having hinge 132, where upper portion 112 is coupled to lower portion 114 via hinge 132. Similar to track arm 104, track arm 106 may also include hinge 134 coupling upper portion 116 to lower portion 118 of track arm 106. As shown in FIGS. 2-4, the track arms, e.g., track arm 104, may fold about the hinges (e.g., hinge 132) to enable adjustment of the vehicle paths 108, 110 and/or to enable a more compact storage of track set 100. In one embodiment, by using folding track arms, it is possible to enable compact storage of the track set 100 without disassembly, although disassembly may also be used, if desired.

In one example, a user may hold and manipulate track arms 104, 106 via handles 140, 142, respectively. The handles may further include a release trigger, such as trigger 146 coupled to release tab 146 for controlling release of a vehicle, such as vehicle 152. Similarly, vehicle 150 is shown after being released traveling along vehicle pathway 108.

Platform 102 may be any suitable stage and/or intersection where two or move toy vehicles are configured to collide or impact to create a collision, such as collision 180 between vehicles 182 and 184. As noted herein, platform 102 may further include additional impact features into which the toy vehicles may be configured to collide and/or avoid. For example, the platform may include impact features or obstacles, such obstacles 136, targets (see FIG. 2) or various others. Although described in regards to a platform, the platform may be any zone into which the track arms direct the vehicles. Thus, in some embodiments, the platform may include a side-by-side race track, a stunt zone, and/or an area where the vehicle paths converge or substantially converge.

Track set 100 may have various themes, such as a sport theme. In the embodiment shown in FIG. 1, the track set may include a racetrack theme in which various decorations, indicia, and/or icons are provided. For example, the track set may be fashioned after a raceway stadium, in which the vehicles may be aimed and propelled to or through a finish line, such as such as through finish line 168. Further, the track set may include various features, such as banners and/or screens, stadium seating, and/or backdrop 190. Also, a flagger character may also be provided which can be positioned on the finish line 168.

Users may find increased play value with the disclosed track set. For example, users may compete to keep their vehicles on the platform. One objective in such play may be to knock or push a competitor's vehicle (or obstacle or other vehicle) off the platform (e.g., out of bounds). A single user may further find enhanced play value by attempting to have certain vehicles remain on the platform or be the first to travel through the platform to a finish line 168 while knocking other vehicles or obstacles off the platform, avoid and/or collide with obstacles/targets, and/or meet certain aiming objectives. Further, in other embodiments, users may position the track arms such that the vehicles travel side-by-side upon release from their respective launchers. Racing games and speed games may be played in such a configuration.

FIG. 2 further illustrates the track set of FIG. 1 in an alternative configuration. In FIG. 2, track arm 104 is shown aimed at the platform 102 to create vehicle pathway 206 (which is also angled relative to ramp 160). Further, track arm 104 is shown partially bent about hinge 134 such that upper portion 112 is angled relative to lower portion 114. Further, track arm 104 is aligned with ramp 162 to create vehicle pathway 204, where the upper and lower portions 116 and 118 are substantially aligned with one another.

FIG. 2 also illustrates cut-outs 202 which may be included in the track arms and/or ramps. While this example shows three rectangular cut-outs, any number of cut-outs may be used. Further, the cut-outs may include directional indicators to aid in directing a user how vehicles may travel in the track set.

As described herein, various moveable and/or integral obstacles and/or targets may be included in the track set 100. FIG. 2 shows an example target 200, which may be formed in the shape of fire, and hinged about the platform surface. Further, the target 200 may be spring loaded such that if impacted by a vehicle, it may temporarily be knocked down. Alternatively, it may be hinged with a plurality of detent positions to enable different positioning. In the retracted position, target 200 may be flush with the platform surface.

FIG. 2 also illustrates that the track set 100 may include two sections, an end section 210 and a platform section 212 which are coupled together via hinge 214 such that the track set may fold about the hinge axis 216 as described herein with regard to FIG. 4 to provide a storage configuration in which the track set 100 is placed in a storage position. Further, there may be multiple platform sections hinged at axis 216 to enable efficient storage. For example, the platform 102 may pivot about hinge axis 216 relative to the ramps 160, 162 and include a tab so that in the play configuration, the platform surface may be angled relative to the ramps.

While FIGS. 1-2 show track set in a play configuration, in one embodiment, track set 100 may be folded into a compact storage configuration without requiring disassembly. FIG. 3 shows track set 100 positioned in a partially folded configuration, and FIG. 4 shows track set 100 positioned in a fully folded configuration.

Specifically, FIG. 3 shows track set 100 in a partially folded configuration in which track arms 104, 106 are rotated about pivot connectors 128, 130 (axis A of FIG. 1) as shown by arrows 308, 310, and each of the track portions are folded about hinges 132, 134 as shown by arrows 304, 306. Specifically, track arms 104, 106 are aligned with one another such that each of the upper and lower track portions 112, 114, 116, and 118 are aligned in a common plane, which may be a vertical plane parallel to backdrop 190. Further, finish line 168 is shown folded about hinge 302 to be positioned flat against the platform 102.

To complete the conversion to a storage configuration, the track arms may be rotated within the common plane (about axis B of FIG. 1) and the platform section 212 folded about hinge 216 to be adjacent the track arms 104, 106.

FIG. 4 shows track set 100 in a fully folded configuration in which track arms 104, 106 are aligned with one another and folded such that they are held between backdrop 190 and platform section 212. In the embodiment of FIG. 4, a surface of the collision platform 102 may be adjacent the folded first and second track arms. As shown, the fully folded configuration may provide for compact storage of the track set, without requiring disassembly and/or reassembly to return to the play configuration.

FIG. 4 also illustrates that end section 210 may include a storage zone 402 in which a plurality of receivers 404, 406, 408 are defined for storing, holding, and/or displaying vehicles 416, 418, and 420. The receivers may be defined in a plurality of different ways, such as being defined by a recess 414 in backdrop 190. Additionally, the receivers may be defined in a rear region of end section 210 such that they may be partially hidden and/or retained by a foldable cover 410.

The track set may include one or more features to retain the track set 100 in the folded configuration. For example, tabs on track arms 104, 106 may mate to cut-outs in the ramps to enable the track set to maintain the folded configuration. The cut-outs in the track arms may also enable projections from other components to nest in the cut-out when in the folded configuration, such as trigger 146. Further, various features may also be used as handles for carrying, such as the recess 414 in backdrop 190.

While FIGS. 1-4 show one embodiment of structure and a corresponding method to reconfigure the track set between a play and storage configuration, various others may be used. For example, disassembly of one or more components may be used. Also, while FIG. 4 shows the track set 100 folded into a generally box-shaped region (which is substantially square and has a depth substantially less than it length and width), any other suitable storage shape may be used.

While the present invention has been described in terms of specific embodiments, it should be appreciated that the spirit and scope of the invention is not limited to those embodiments. For example, various additional features may be included to improve the play and/or storage configuration, such as foldable foot elements formed in the end section 210 to improve stability in the play configuration, yet still maintain compactness in the storage configuration. The features, functions, elements and/or properties, and/or combination and combinations of features, functions, elements and/or properties of the track set may be claimed in this or a related application. All subject matter which comes within the meaning and range of equivalency of the claims is to be embraced within the scope of such claims.

The invention claimed is:

1. A track set for toy vehicles comprising:

a first adjustable and foldable track arm, including a first vehicle launcher for a first vehicle;

a second adjustable and foldable track arm, including a second vehicle launcher for a second vehicle;

an end section, where each of the first and second adjustable and foldable track arms is rotatably coupled to the end section and adjustable about at least two axes relative to the end section; and a platform section, the platform section being movably coupled to the end section.

2. The track set of claim 1, where the first and second track arms may be positioned to be aimed at the platform section.

3. The track set of claim 1 where each of the track arms is foldable about a hinge.

4. The track set of claim 1 further comprising an obstacle positioned in the platform section.

5. The track set of claim 1 wherein the platform section includes at least two ramps, where and the first and second track arms may each be aligned with one of the ramps.

6. The track set of claim 1, wherein each launcher may be individually actuated, and where the first and second track arms may be positioned such that gravity launches vehicles from the launcher of each track arm to the platform section.

7. The track set of claim 1 wherein the platform section includes a collision surface on which the vehicles collide.

8. The track set of claim 7, where the track set may be reconfigured between a first play configuration and a second storage configuration, where in the second storage configuration, the first and second track arms are folded in a common plane, and where the platform section is folded such that the collision surface is adjacent the folded first and second track arms.

9. The track set of claim 8 where the track arms remain coupled to the end section in each of the first play configuration and the second folded storage configuration.

10. A track set for toy vehicles comprising:

a first section having first and second adjustable and foldable track arms rotatably coupled thereto, the first track arm including a first vehicle launcher for a first vehicle and the second arm including a second vehicle launcher for a second vehicle, where the first and second vehicle launchers are manually and individually actuated, and the first and second track arms are each adjustable about at least two axes relative to the first section;

a second section, the second section having a platform for receiving the first and second vehicles at a plurality of vehicle pathways, the second section further having a foldable target and a ramp; and a hinge, where the first section is moveably coupled to the second section via the hinge and where the ramp and the platform are moveable relative to one another about the hinge.

11. The track set of claim 10 where the track set may be positioned in a folded configuration about the hinge.

12. The track set of claim 11 where in the folded configuration, the first and second sections are positioned substantially adjacent one another.

13. The track set of claim 11 where in the folded configuration, the first and second track arms are aligned in a common plane.

14. The track set of claim 11 where in the folded configuration, the foldable target is folded adjacent the second section.

15. The track set of claim 11 where the first section further comprises a receiving zone defined to receive and hold a toy vehicle at least in the folded configuration.

16. The track set of claim 10 wherein the second section includes at least a first and second ramp.

17. The track set of claim 10 wherein the platform includes a plurality of obstacles.

* * * * *